US006279521B1

(12) United States Patent
Ishida et al.

(10) Patent No.: US 6,279,521 B1
(45) Date of Patent: Aug. 28, 2001

(54) TWO-CYCLE ENGINE

(75) Inventors: Shigetoshi Ishida; Naoki Tsuruoka, both of Chiba; Yasuhiro Sensui, Ichihara, all of (JP)

(73) Assignee: Tanaka Kogyo Co., Ltd., Chiba (JP)

( * ) Notice: Subject to any disclaimer, the term of this patent is extended or adjusted under 35 U.S.C. 154(b) by 0 days.

(21) Appl. No.: 09/459,021

(22) Filed: Dec. 10, 1999

(30) Foreign Application Priority Data

Dec. 15, 1998 (JP) ..... 10-356115

(51) Int. Cl.[7] ..... F02B 33/00
(52) U.S. Cl. ..... 123/73 PP; 123/74 AP
(58) Field of Search ..... 123/65 R, 73 PP, 123/74 AP, 193.2

(56) References Cited

U.S. PATENT DOCUMENTS

| | | | | |
|---|---|---|---|---|
| 4,378,762 | * | 4/1983 | Ehrlich | 123/73 PP |
| 4,516,540 | * | 5/1985 | Nerstrom | 123/65 PE |
| 4,825,821 | * | 5/1989 | Baltz et al. | 123/73 A |
| 4,934,345 | * | 6/1990 | Fukuoka et al. | 123/73 AA |
| 5,740,767 | * | 4/1998 | Kaku et al. | 123/65 W |

FOREIGN PATENT DOCUMENTS 57-13217 1/1982 (JP) .
60-48609 10/1985 (JP) .

* cited by examiner

*Primary Examiner*—Noah P. Kamen
*Assistant Examiner*—Hai Huynh
(74) *Attorney, Agent, or Firm*—Frishauf, Holtz, Goodman, Langer & Chick, P.C.

(57) ABSTRACT

A two-cycle engine includes scavenging passages on the cylinder side and the crankcase side as the passages to supply scavenging gas into the cylinder. The passage on the cylinder side includes a passage inside the cylinder sidewall having substantially the same inner diameter as that of the opening area of the scavenging charge port, while the passage on the crankcase side includes a space between the inner peripheral surface at the top end of the crankcase and the outer peripheral surface of the piston, and a connection means provided between the top end of the space and the lower end of the scavenger passage of the cylinder. As the fuel mixture in the crank chamber flows into the scavenging passage on the cylinder side through the narrow space of the passage on the crankcase side and the connection means, the rapid inflow of the fuel mixture into the cylinder is restrained and the supply of the fuel mixture is sustained constantly high until the latter half of the scavenging time. This enables an optimum supply of fuel mixture, and radically decreases the amount of unburned gas in the fuel mixture that is emitted with the exhaust gas.

3 Claims, 6 Drawing Sheets

Flow quantity of fuel mixture flowing into cylinder

TWO-CYCLE ENGINE

BACKGROUND OF THE INVENTION AND RELATED ART

This invention concerns two-cycle engines, and more particularly loop scavenging type two-cycle engines with improvements made to scavenging passages.

This type of loop scavenging two cycle engine 51 known in the prior art has the construction shown in FIG. 12 wherein scavenging passages 56 extend upward from the top of a crank chamber 55 inside the sidewall of a cylinder 53, the passages 56 connect with scavenging charge ports 57 inside the cylinder 53, and the piston 54 is lowered to charge the fuel mixture from the inlet port into the crank chamber 55 and to the cylinder 53 from the scavenging charge ports 57 via the scavenging passages 56. Such a construction is disclosed, for instance, in Japanese Patent Publication Sho60-48609.

Another construction of a two-cycle engine is disclosed in Japanese Utility Model Kokai Sho57-13217 wherein a passage from the bottom of the crank chamber to the top surface of the crankcase is formed through the crankcase sidewall, and the passage is connected to the scavenging passage on the cylinder side to supply the fuel mixture to the crank chamber to the cylinder.

Of the engines discussed above, the engine shown in FIG. 12 has the inner diameter (the cross sectional area in the horizontal direction) of the scavenging passage 56 formed substantially vertical inside the sidewall of the cylinder 53 from above the crank chamber which is substantially the same as that of the area of the opening of the scavenger port 57. Therefore, as the fuel mixture forced outside the crank chamber 55 rapidly flows into the cylinder 53 from the scavenging charge port 57, a portion of unburned fuel mixture is emitted to the atmosphere from the outlet port 59 with the exhaust gas, the emitted amount being more than 30% of the scavenging gas flowing into the cylinder 53. This is criticized as hazardous to the natural environment.

The engine disclosed in Japanese Utility Model Kokai No. Sho57-13217 has a drawback in that the smooth supply of scavenging gas is prevented or the supply to the cylinder is altogether suspended by the negative pressure inside the scavenging passages as the rotational speed of the engine increases and the scavenging passages resonate.

SUMMARY OF THE INVENTION

In view of the problems encountered in the prior art loop scavenging engines as discussed above, this invention aims to offer engines adapted for resource preservation and environment conservation by improving combustion efficiency through controlling emission of unburned scavenging gas.

The two-cycle engine according to the present invention comprises a scavenging passage on the cylinder side and another scavenging passage on the crankcase side for supplying scavenging gas to the cylinder, and the said engine is characterized in that the passage on the cylinder side comprises a passage inside the cylinder sidewall having the inner diameter substantially the same as that of the opening of the scavenging charge port, and the scavenging passage on the crankcase side consists of a space provided between the inner peripheral surface at the top end of the crankcase and the outer peripheral surface of the piston and a connection means provided between the top end of the space and the lower end of the said scavenging passage on the cylinder side.

When the fuel mixture in the crank chamber is supplied to the scavenging passage on the cylinder side from the passage on the crankcase side with the lowering of the piston in this engine, the rapid fuel mixture flow from the passage on the cylinder side to the cylinder is restrained and the flow slows down restricted by the narrow space and the connection means between these passages. As a result, not only the fuel mixture is smoothly supplied, but also the amount of unburned gas emitted into the atmosphere with exhaust gas is decreased to less than half of the prior amount.

DETAILED DESCRIPTION OF THE PREFERRED EMBODIMENTS

Figure 1:
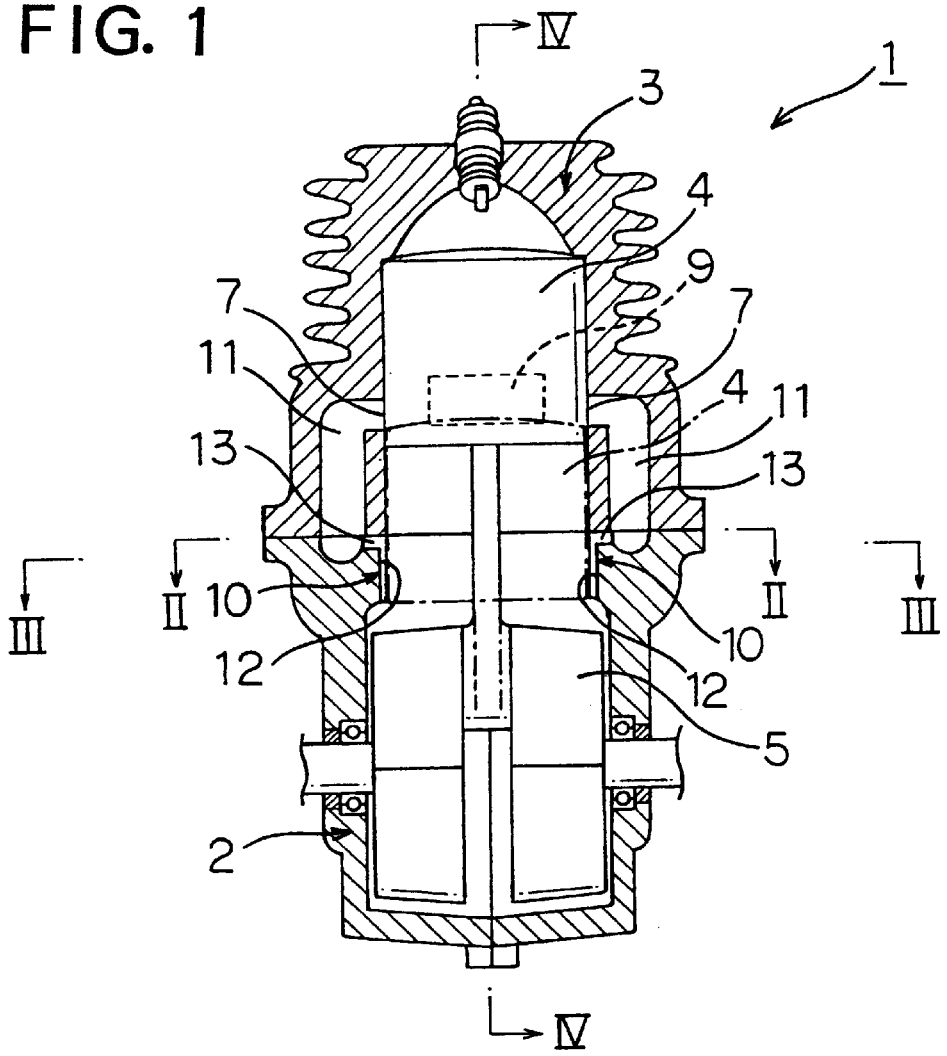
FIG. 1 is a vertical cross sectional view of the first embodiment two-cycle engine according to the present invention.

The first embodiment two-cycle engine according to the present invention is described by referring to FIGS. 1 through 4. As shown in FIGS. 1 and 2*a,* the engine 1 has a space 12 between the crankcase 2 and the piston 4 by somewhat enlarging the inner peripheral surface at the top end of the crankcase 2 than the outer diameter of the piston 4. Atop the crankcase 2 positioned at corresponding point of the outlet port 9 opening onto the cylinder 3, a connection means 13 is provided by cutting a portion of the top end of said crankcase 2 in the horizontal direction, and a scavenging passage 10 on the crankcase side is formed by said space 12 and said connection means 13.

Figure 4:
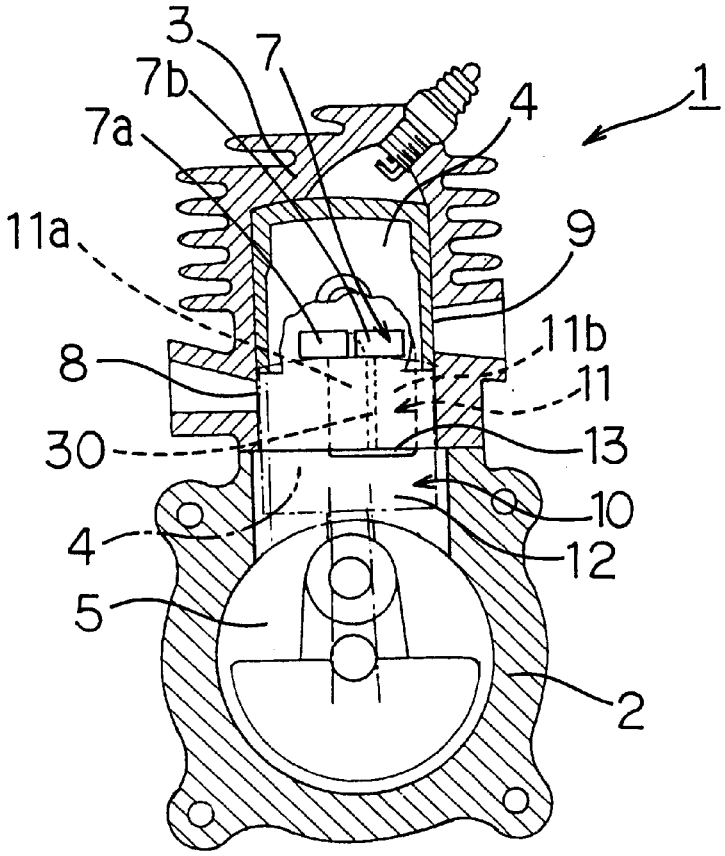
FIG. 4 shows the cross section along the line IV—IV of FIG. 1.

On the other hand, the cylinder 3 has an inlet port 8 on the side opposite the outlet port 9 as shown in FIG. 4, and a pair of scavenging passages 11 consisting of holes bore along the longitudinal direction of the cylinder 3 inside the left and the right sidewalls of the cylinder 3 as shown in FIG. 1. The lower end of the scavenging passage 11 on the cylinder side connects with the connection means 13 of the scavenging passage 10 on the crankcase side.

The said passage 11 has a scavenging charge port 7 opening onto the cylinder 3 at its top end and is sectioned into a passage 11*a* far from the exhaust port 9 and a passage 11*b* near the exhaust port 9 by a partition wall 30 at the center along the longitudinal direction as shown in FIG. 4. The scavenging charge port 7 at the top end of the passages 11*a* and 11*b* is also sectioned into a scavenging charge port 7*a* far from the exhaust port 9 and a port 7*b* near the exhaust port 9 by the partition wall 30 of which top end extends upward.

The inner diameter (the cross sectional area in the horizontal direction) of the above mentioned passage 11 on the cylinder side consisting of passages 11*a* and 11*b* sectioned by the partition wall 30 is substantially the same as that of the openings of the scavenging charge ports 7*a* and 7*b* sectioned by the partition wall 30. The fuel mixture supplied from the inlet port 8 into the crank chamber 5 passes through the passage 10 on the crankcase side and the passages 11*a* and 11*b* on the cylinder side to be supplied into the cylinder 3 from the scavenging ports 7*a* and 7*b*.

The space 12 between the inner peripheral surface at the top end of the crankcase 2 and the outer peripheral surface of the piston 4 consisting the scavenging passage 10 on the crankcase side is formed between the inner peripheral surface of the crankcase 2 and the outer peripheral surface of the piston 4 when the piston 4 is lowered to be near the lower dead point on the side of the crankcase 2, and the inner diameter of the inner peripheral surface at the top end of the crankcase 2 is larger by 2 to 4% than the outer diameter of the piston 4. More concretely, if the outer diameter of the piston 4 is 40 mm, the space 12 of about 0.5 mm is formed.

The connection means 13 provided on the top surface of the crankcase 2 corresponding to the lower end of the scavenging passage 11 on the cylinder side is formed by cutting the top surface of the crankcase 2 to the depth of approximately 0.5–1 mm in order to allow the inflow of fuel mixture of the crank chamber 5 into the scavenger passages 11*a,* 11*b* on the cylinder side from the space 12 through the connection means 13.

Figure 2A:
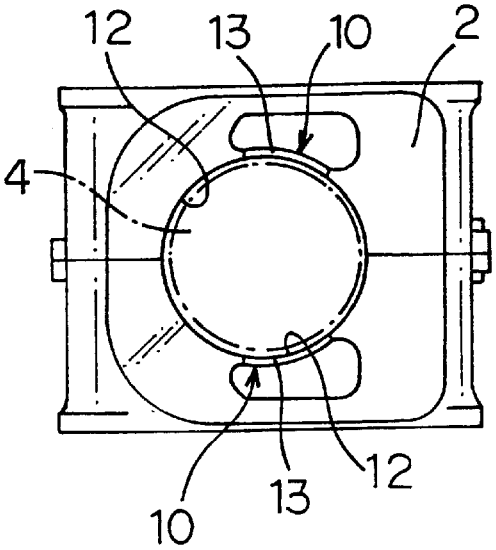
FIG. 2*a* shows the cross section along the line II—II of FIG. 1, and FIG. 2*b* a plan view of the surface of the said cross section mounted with packing.
Figure 2B:
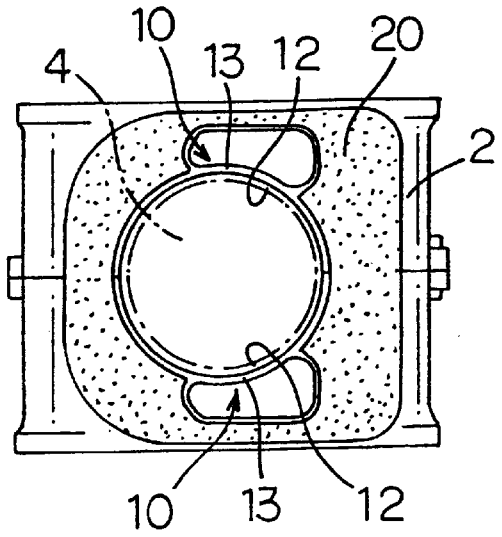
Figure 3:
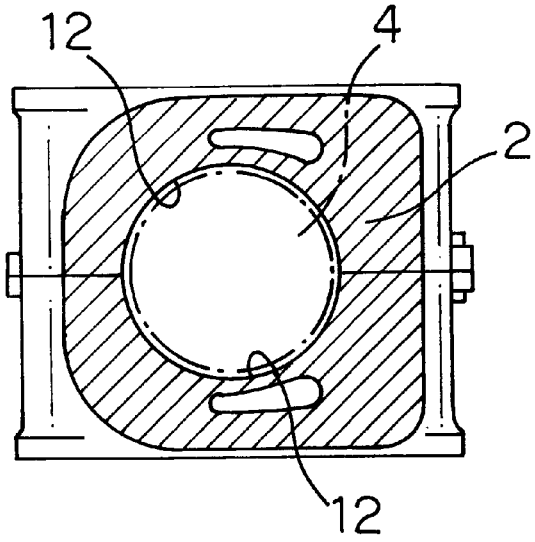
FIG. 3 shows the cross section along the line III—III of FIG. 1.

In addition to providing the connection means 13 by cutting the top surface of the crankcase 2 as shown in FIG. 2*a,* a packing 20 of about 0.5 mm thickness may be mounted at the juncture of the crankcase 2 and the cylinder 3 and a portion of the inner peripheral surface of the packing 20 connecting to the scavenging passage 10 on the crankcase side may be cut in order to form the connection means 13 as shown in FIG. 2*b*. When the packing 20 is embedded in the top surface of the crankcase 2, a portion of the packing 20 and the top surface of the crankcase 2 may be cut in order to provide the connection means 13.

Figure 5:
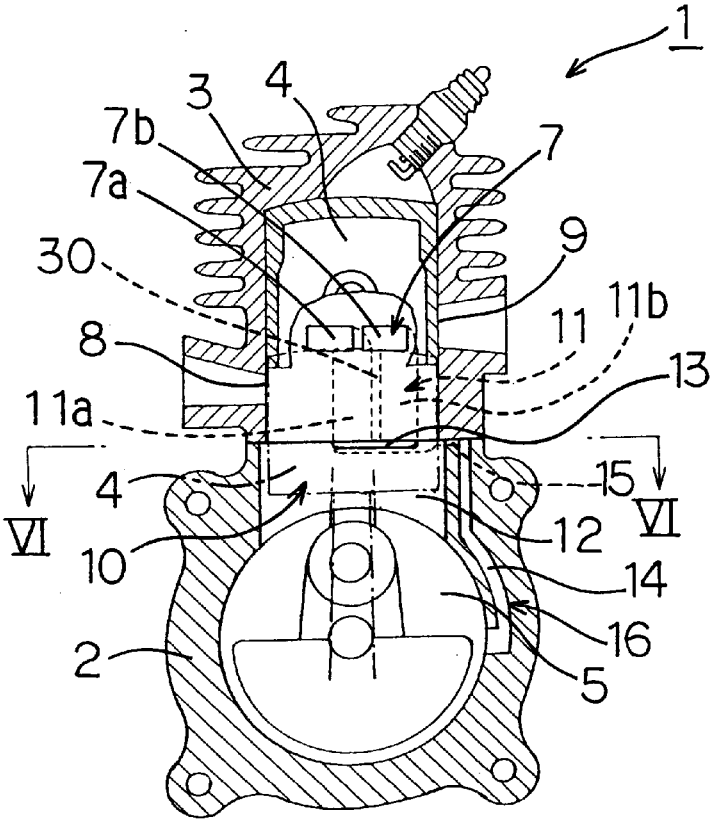
FIG. 5 is a vertical cross sectional view of the second embodiment of the present invention.
Figure 6:
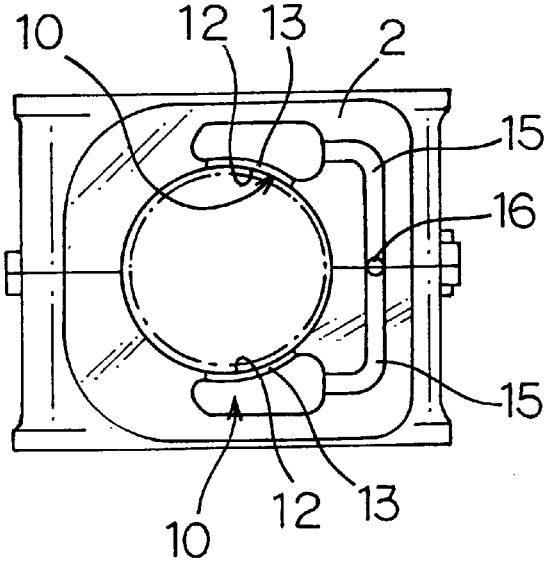
FIG. 6 shows the cross section along the line VI—VI of FIG. 5.

FIGS. 5 and 6 show the second embodiment of the present invention wherein a passage 14 is provided in addition to the passage 10 on the crankcase side, the passage 14 extending from an arbitrary position in the crank chamber 5 into the sidewall of the crankcase 2. As shown in FIG. 6, there is provided an auxiliary scavenging passage 16 connecting the top end of the passage 14 to the scavenging passage 11 on the cylinder side via a horizontal scavenging groove 15 at the top end of the crankcase 2, thus forming two channels of scavenging passages.

Figure 7:
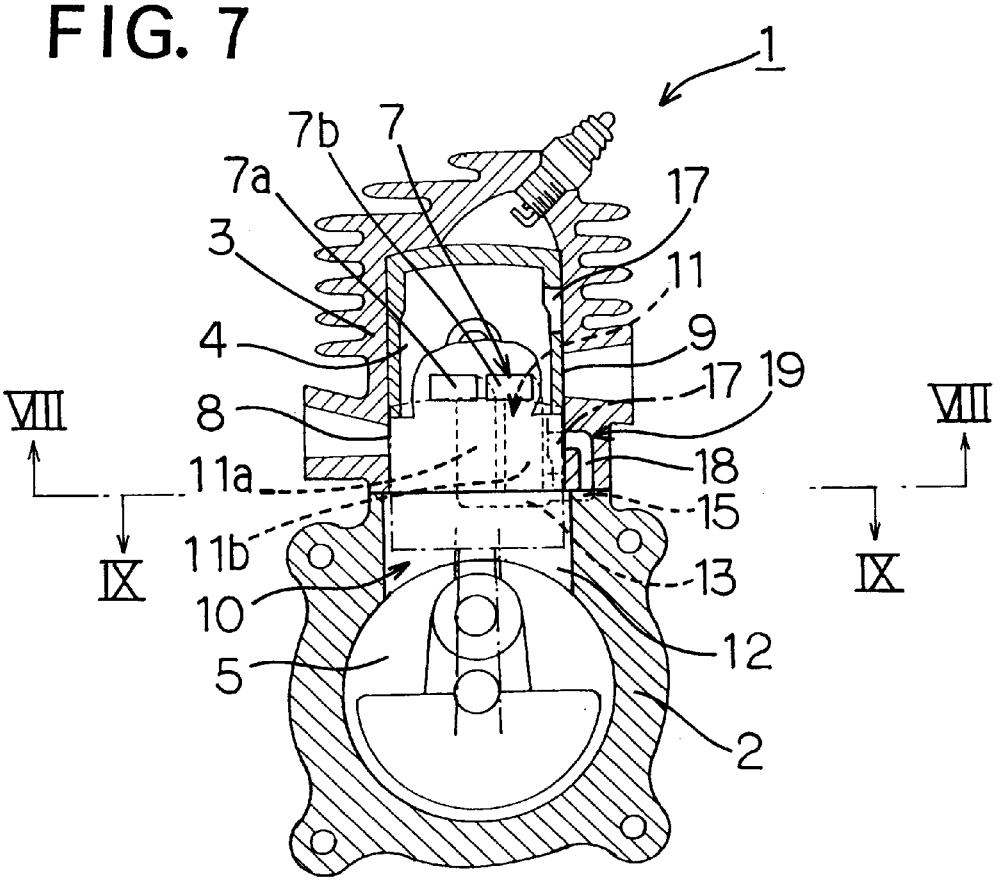
FIG. 7 is a vertical cross sectional view of the third embodiment of the present invention.
Figure 8:
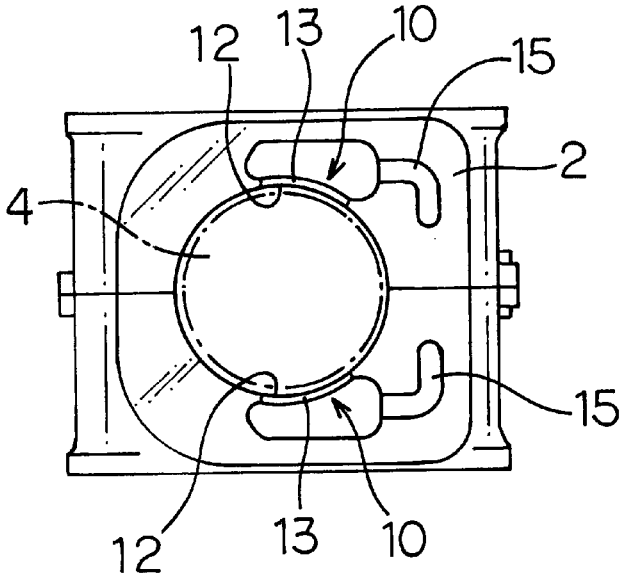
FIG. 8 shows the cross section along the line VIII—VIII of FIG. 7.
Figure 9:
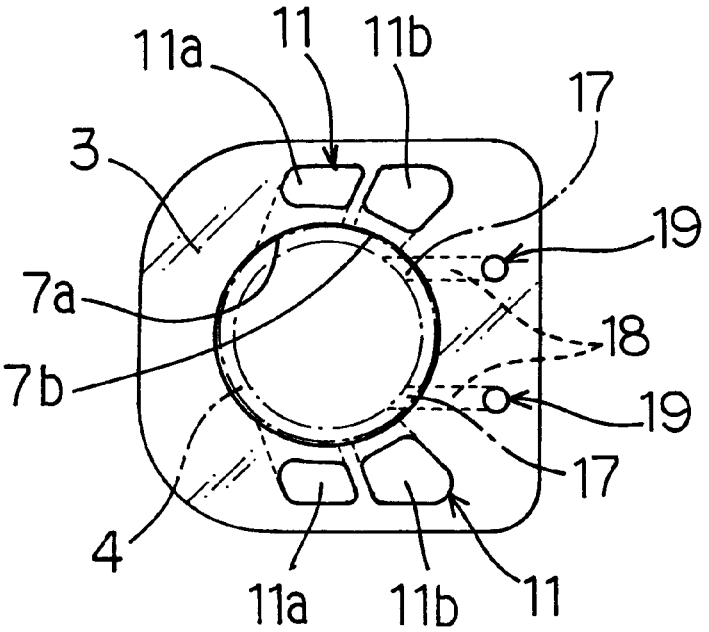
FIG. 9 shows the cross section along the line IX—IX of FIG. 7.
Figure 10:
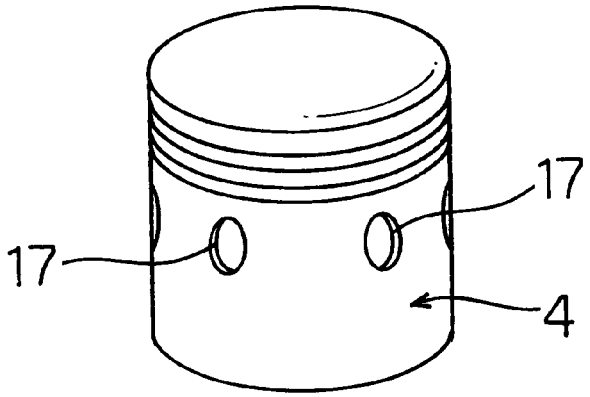
FIG. 10 is a perspective view of the piston comprising the third embodiment of the present invention.

The third embodiment of the present invention shown in FIGS. 7 through 10 employs an auxiliary scavenging passage as well. As shown in FIG. 10, a through hole 17 penetrates into the piston 4 at a prescribed position on the outer peripheral surface of the piston 4, for instance, at the position close to the exhaust port 9 of the cylinder 3. As is shown in FIG. 7, there is provided a passage 18 leading from the inner peripheral surface of the cylinder 3 corresponding to the said hole 17 through the sidewall to the lower surface of the cylinder 3 when the piston 4 lowers and reaches the lower dead point inside the sidewall near the exhaust port 9 of the cylinder 3. By connecting the lower end of the passage 18 with the horizontal scavenging passage 15 formed at the juncture of the upper end of the crankcase 2 and the lower end of the cylinder 3, an auxiliary scavenging passage 19 connecting with the passage 11 on the cylinder side is formed. Thus, there are formed two channels of scavenging passages by the auxiliary passage 19 and the scavenging passage 10 on the crankcase side.

When the piston 4 rises to reach the upper dead point in the cylinder 3 in the engine according to the first embodiment, the fuel mixture is supplied from the inlet port 8 opening onto the lower part of the cylinder 3 and into the crank chamber 5.

When the piston 4 reaches the upper dead point, the fuel mixture compressed inside the cylinder 3 explodes and burns, and when the piston 4 lowers toward the crankcase 2, the fuel mixture is compressed in the crank chamber 5 and is supplied to the scavenging passage 11 on the cylinder side through the clearance 12 from the piston 4 and the connection means 13 comprising the scavenging passage 10 on the crankcase side.

In the engine according to the second embodiment, when the piston 4 lowers and compresses the inside of the crank chamber 5, the mixture is supplied to the scavenging passage 11 on the cylinder side from the passage 10 on the crankcase side consisting of the space 12 and the connection means 13. Apart from this route of supply, the fuel mixture in the crank chamber 5 is supplied from the passage 14 inside the sidewall of the crankcase 2 to the scavenging passage 11 on the cylinder side via the auxiliary passage 16, thus enabling efficient supply of the fuel mixture to the passage 11 on the cylinder side via two channels, viz. scavenging passages 10, 16.

The fuel mixture inside the crank chamber 5 is similarly compressed by the lowering of the piston 4 in the engine according to the third embodiment, and when the fuel mixture in the crank chamber 5 is supplied to the passage 11 on the cylinder side from the passage 10 on the crankcase side which consists of the space 12 and the connection means 13, the hole 17 of the piston 4 connects with the passage 18 inside the sidewall of the cylinder 3. There is opened an auxiliary passage 19 connecting the passage 18 with the horizontal passage 15 below to supply the fuel mixture inside the crank chamber 5 from the piston 4 via the hole 17 to the auxiliary passage 19 and further to the passage 11 on the cylinder side. Thus, the fuel mixture is efficiently supplied to the scavenging passage 11 on the cylinder side by passing through the two scavenging passages 10 and 19.

In the first embodiment engine, the fuel mixture in the crank chamber 5 is supplied to the scavenging passage 11 on the cylinder side through the space or clearance 12 from the piston 4 forming the passage 10 on the crankcase side, and the connection means 13 when the piston 4 lowers to the side of the crankcase 2. Since the passage 10 consists of a narrow clearance 12 and a connection means 13, the fuel mixture is restrained from rapidly flowing into the cylinder 3 from the passage 11 on the cylinder side.

Figure 12:
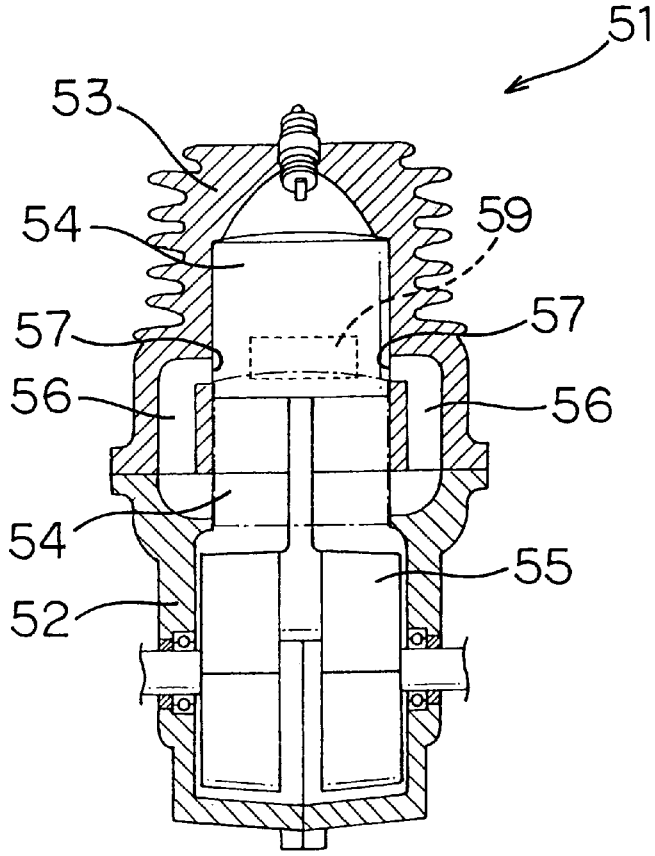
FIG. 12 is a cross sectional view of a conventional type engine.

As is evident from FIG. 12 showing a conventional engine, the areas of the opening on the crankcase side of the scavenging passage 56 and the scavenging charge port 57 are about the same as the inner diameter of the scavenging passage 56. This means that during the time zone when the piston 54 lowers and scavenges the inside of the cylinder 53, the scavenging gas rapidly flows into the cylinder 53 and about 30% of said gas is emitted outside in the exhaust gas without burning.

Figure 11:
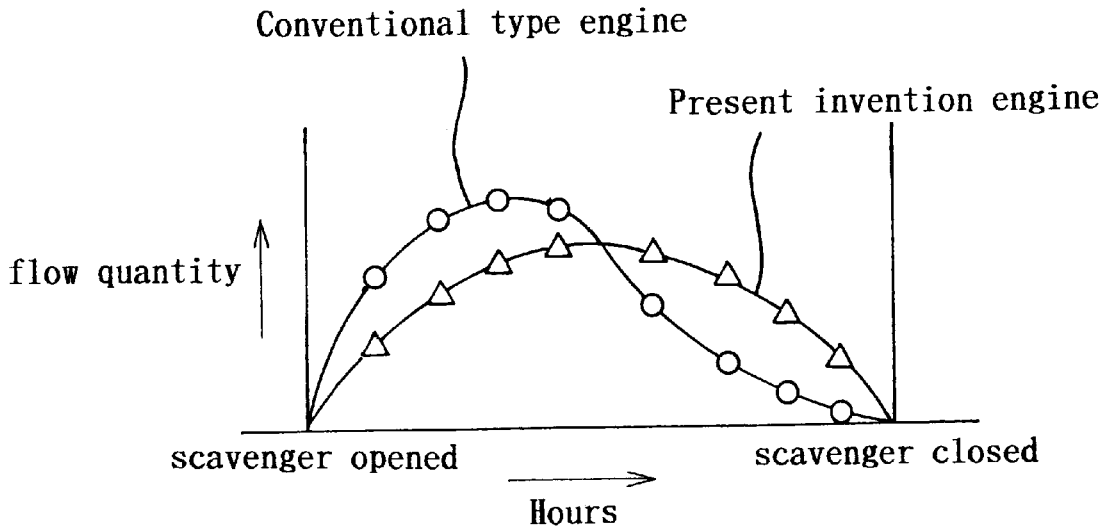
FIG. 11 is a graph comparing the flow rate and the time of the fuel mixture charged into the cylinder of the present invention and the conventional type engines.

In view of such problems, the present invention engine was contrived by causing the fuel mixture in the crank chamber 5 to pass through the scavenging passage 10 on the crankcase side consisting of a narrow space 12 and a connection means 13, restraining the rapid inflow of the mixture into the cylinder 3 as shown in FIG. 11, and maintaining the gradual speed of fuel mixture supply until the latter half of the scavenging time zone. This brings about not only the smooth supply of the fuel mixture, but limits the amount of unburned gas emitted with the exhaust gas to less than half of the amount emitted by the conventional type engine.

When the fuel mixture is supplied to the cylinder 3 via the space 23 and the connection means 13, the amount of mixture is controlled, and the inflow into the cylinder 3 is somewhat decreased compared to the conventional type engine. This may somewhat lower the engine output during the high speed rotation, but the lowered output in no way creates problems at the normal rotational speed for operating the work machines, and does not deteriorate the performance thereof.

As the space 12 of the passage 10 on the crankcase side is formed between the inner peripheral surface at the top end of the crankcase 2 and the outer peripheral surface of the piston 4, the fuel mixture concentrates along the outer peripheral surface of the piston 4 and cools the piston 4 effectively when the piston 4 becomes heated under the high load operating conditions.

As the heat exchange occurs to the fuel mixture as it passes alongside the outer peripheral surface of the piston 4, vaporization of the liquid contained in the fuel mixture is promoted by the heat of the piston 4, the combustion efficiency is further enhanced.

According to the second embodiment engine, the piston 4 lowers to supply the fuel mixture in the crank chamber 5 to the cylinder 3 from the passage 10 on the crankcase side to the passage 11 on the cylinder side as well as to the cylinder 3 from the auxiliary scavenging passage 16 in the sidewall of the crankcase 2 and the passage 11 on the cylinder side. This enables supplying of sufficient amount of scavenging gas into the cylinder 3 and prevents the lowering of engine output.

Since two systems of scavenging passages, the passage 10 on the crankcase side and the auxiliary passage 16, are provided to this engine, it is possible to prevent generation of oscillations or negative pressure in the auxiliary passage 16 during the high speed rotation of the engine 1 as is often encountered in the conventional type engine having only the scavenging passage corresponding to the auxiliary scavenging passage 16, and to avoid inconveniences of non-smooth supply or failure to supply of scavenging gas into the cylinder 3.

In this engine, the fuel mixture is charged onto the bottom of the scavenging passage 11 on the cylinder side horizontally by passing it through the horizontal scavenging passage 15 of the auxiliary passage 16. This enables charging the dense fuel mixture containing fuel particles of large masses to the lower end of the passage 11*a* far from the exhaust port 9 sectioned by the partition 30 or the innermost portion of the bottom of the scavenging passage 11 on the cylinder side by the kinetic energy in the horizontal direction, so that the mixture may be charged into the cylinder 3 from the scavenging charge port 7*a* apart from the exhaust port 9. By concurrently providing the scavenging passage 10 on the crankcase side and the auxiliary scavenging passage 16, the fuel mixture of higher concentration can be supplied into the cylinder 3 to thereby enhance the combustion efficiency.

FIGS. 2*a* and 6 show the connection means 13 of the scavenging passage 10 on the crankcase side having substantially the same width as that of the scavenging passage 11 on the cylinder side consisting of the passages 11*a* and 11*b*. If the width of the connection means 13 was made smaller so that it could connect only with the passage 11*a* on the side far from the exhaust port 9 of the passage 11 on the cylinder side, the dense fuel mixture containing fuel particles of larger masses that flows into the bottom of the scavenging passage 11 on the cylinder side can be charged into the cylinder 3 from the scavenging charge port 7*a* far from the exhaust port 9 via the passage 11*a,* and the less dense fuel mixture may be supplied from the passage 11*b* near the exhaust port 9, to thereby increase the difference in concentration of the fuel mixtures passing through the passage 11*a* or 11*b*. By not supplying the dense fuel mixture form the passage 11*b* near the exhaust port 9, it is possible to securely prevent emission of unburned gas from the exhaust port 9.

According to the third embodiment engine, the piston 4 lowers to supply the fuel mixture in the crank chamber 5 to the cylinder 3 from the scavenging passage 10 on the crankcase side through the scavenging passage 11 on the cylinder side and also from the auxiliary scavenging passage 19 inside the sidewall of the cylinder 3 and the hole 17 of the piston 4 via the scavenging passage 11 on the cylinder side. In addition to achieving a similar effect as in the second embodiment, the fuel mixture in the crankcase 2 is sent to the auxiliary scavenging passage 19 provided inside the sidewall of the cylinder 3 of a higher temperature via the hole 17 from inside the piston 4, which is also of a high temperature. This promotes vaporization of the fuel mixture, enhances the combustion efficiency, and decreases harmful components of the exhaust air.

In this engine, moreover, a constant flow of the new fuel mixture is maintained inside the piston 4 from the crankcase 2 and effectively cools the piston 4, particularly the end of the connecting rod and the side of the exhaust port 9 of the cylinder 3. The problems such as burnt out or lowered output can be avoided and the durability of the machine prolonged.

By suitably setting the position of the hole 17 bored in the piston 4, the position, size and shape of the opening of the passage 18 provided in the sidewall of the cylinder 3 in this engine, the timing and duration of opening of the scavenging charge port 7 may be varied, and the amount of scavenging gas and discharge timing may be adjusted.

For instance, if the time when the scavenging port 7 is open by connection of the hole 17 of the piston 4 and the passage 18 of the cylinder 3 is set short, the fuel mixture does not flow into the scavenging passage 11 on the cylinder side from the auxiliary scavenging passage 19 even when the pressure inside the crank chamber 5 rises unless the piston 4 lowers and the hole 17 connects with the passage 18. The flow of the scavenging gas charged into the cylinder 3 from the scavenging port 7 is, therefore, not so rapid, but when the auxiliary scavenging passage 19 is connected as the piston 4 lowers and the hole 17 and the passage 18 are connected, the amount of scavenging gas increases suddenly and rapidly. This enables efficient scavenging inside the cylinder 3 and appropriately prevents discharge of scavenging gas from the discharge port 9 as unburned gas.

The length of the auxiliary scavenging passage 19 consisting of the hole 17 of the piston 4 and the passage 18 in the third embodiment can be made shorter than the auxiliary passage 16 of the second embodiment, and by suitably controlling the timing of connecting the hole 17 of the piston 4 and the passage 18, it is possible to concentrate the supply of the fuel mixture from the auxiliary passage 19 in the midst of the scavenging process, to conduct the gas exchange in the cylinder 3 efficiently, and improve the output.

What is claimed is:

1. A two-cycle engine comprising a scavenging passage on a cylinder side and a scavenging passage on a crankcase side as passages for supplying scavenging gas into a cylinder, wherein the scavenging passage on the cylinder side includes a passage provided in a cylinder sidewall so that its inner diameter is approximately the same as that of an opening of a scavenging port, and the scavenging passage on the crankcase side includes a space between an inner peripheral surface of the top end of the crankcase and the outer peripheral surface of the piston and a connector provided between the top end of the space and the lower end of the scavenging passage on the cylinder side, wherein the space between the inner peripheral surface of the top end of the crankcase and the outer peripheral surface of the piston is made larger by increasing the inner diameter of the inner peripheral surface at the top end of the crankcase by 2 to 4% than the outer diameter of the piston.

2. A two-cycle engine comprising a scavenging passage on a cylinder side and a scavenging passage on a crankcase side as passages for supplying scavenging gas into a cylinder, wherein the scavenging passage on the cylinder side includes a passage provided in a cylinder sidewall so that its inner diameter is approximately the same as that of an opening of a scavenging port, and the scavenging passage on the crankcase side includes a space between an inner peripheral surface of the top end of the crankcase and the outer peripheral surface of the piston and a connector provided between the top end of the space and the lower end of the scavenging passage on the cylinder side, wherein an auxiliary scavenging passage is provided in addition to the scavenging passage on the crankcase side having a space between the inner peripheral surface of the top end of the crankcase and the outer peripheral surface of the piston, and the fuel mixture is supplied through an auxiliary scavenging passage through the passage in the sidewall of the crankcase and a horizontal passage provided at the juncture of the top end of the crankcase and the lower end of the cylinder.

3. A two-cycle engine comprising a scavenging passage on a cylinder side and a scavenging passage on a crankcase side as passages for supplying scavenging gas into a cylinder, wherein the scavenging passage on the cylinder side includes a passage provided in a cylinder sidewall so that its inner diameter is approximately the same as that of an opening of a scavenging port, and the scavenging passage on the crankcase side includes a space between an inner peripheral surface of the top end of the crankcase and the outer peripheral surface of the piston and a connector provided between the top end of the space and the lower end of the scavenging passage on the cylinder side, wherein an auxiliary scavenging passage is provided to supply the fuel mixture to the scavenging passage on the cylinder side from a horizontal scavenging passage provided at a juncture of a top end of the crankcase and a lower end of the cylinder through the hole penetrating the outer peripheral surface of the piston and the passage provided inside the cylinder sidewall from the inner peripheral surface of the cylinder which connects with the hole when the piston reaches a lower dead point.

* * * * *